US007841417B2

(12) United States Patent
Allison et al.

(10) Patent No.: US 7,841,417 B2
(45) Date of Patent: Nov. 30, 2010

(54) USE OF SWELLABLE MATERIAL IN AN ANNULAR SEAL ELEMENT TO PREVENT LEAKAGE IN A SUBTERRANEAN WELL

(75) Inventors: David B. Allison, Duncan, OK (US); Timothy Bozeman, Mansfield, TX (US); Michael MacDonald, Alvarado, TX (US); Alf K. Sevre, Houston, TX (US); Earl Webb, Wilson, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/276,790

(22) Filed: Nov. 24, 2008

(65) Prior Publication Data

US 2010/0126735 A1 May 27, 2010

(51) Int. Cl.
*E21B 33/14* (2006.01)

(52) U.S. Cl. ..... 166/387; 166/285

(58) Field of Classification Search ..... 166/387, 166/285

See application file for complete search history.

(56) References Cited

U.S. PATENT DOCUMENTS

| | | | | |
|---|---|---|---|---|
| 4,366,284 | A * | 12/1982 | Ishido et al. | 524/447 |
| 4,919,989 | A * | 4/1990 | Colangelo | 428/66.4 |
| 5,145,935 | A | 9/1992 | Hayashi | |
| 6,173,788 | B1 * | 1/2001 | Lembcke et al. | 166/387 |
| 6,769,484 | B2 * | 8/2004 | Longmore | 166/207 |
| 6,848,505 | B2 * | 2/2005 | Richard et al. | 166/285 |
| 7,013,979 | B2 * | 3/2006 | Richard | 166/369 |
| 7,059,415 | B2 * | 6/2006 | Bosma et al. | 166/313 |
| 7,143,832 | B2 | 12/2006 | Freyer | |
| 7,387,165 | B2 * | 6/2008 | Lopez de Cardenas et al. | 166/313 |
| 7,407,007 | B2 | 8/2008 | Tibbles | |

(Continued)

FOREIGN PATENT DOCUMENTS

EP 1793078 A1 6/2007

(Continued)

OTHER PUBLICATIONS

Invitation to Pay Additional Fees issued May 6, 2010 for International Patent Application Serial No. PCT/US09/64553, 4 pages.

(Continued)

*Primary Examiner*—David J Bagnell
*Assistant Examiner*—Blake Michener
(74) *Attorney, Agent, or Firm*—Marlin R. Smith

(57) ABSTRACT

A method of sealing an annulus formed between a casing string and a surface in a well includes: positioning a seal element in the annulus, a swellable material of the seal element being positioned between the casing string and the surface; and flowing cement through a channel formed between the swellable material and the casing string. A method of sealing in a well includes the steps of: positioning an annular seal element comprising a swellable material in the well; and flowing cement into at least one channel formed longitudinally through the seal element. A method of sealing an annulus between two casing strings includes: providing multiple arcuate segments, each of the segments comprising a swellable material; and installing the segments in the annulus, each of the segments thereby occupying a respective circumferential portion of the annulus.

28 Claims, 13 Drawing Sheets

U.S. PATENT DOCUMENTS

| | | | | |
|---|---|---|---|---|
| 7,422,071 | B2 * | 9/2008 | Wilkie et al. | 166/387 |
| 2004/0194971 | A1 * | 10/2004 | Thomson | 166/387 |
| 2005/0199401 | A1 * | 9/2005 | Patel et al. | 166/387 |
| 2008/0041577 | A1 * | 2/2008 | Baaijens et al. | 166/74 |
| 2008/0121390 | A1 * | 5/2008 | O'Malley et al. | 166/207 |
| 2009/0120640 | A1 * | 5/2009 | Kulakofsky et al. | 166/277 |
| 2009/0188678 | A1 * | 7/2009 | Brooks et al. | 166/386 |
| 2009/0272525 | A1 * | 11/2009 | Nutley et al. | 166/241.6 |

FOREIGN PATENT DOCUMENTS

| | | | |
|---|---|---|---|
| GB | 2411918 | A | 9/2005 |
| WO | 2007092082 | A2 | 8/2007 |
| WO | 2007126496 | A2 | 11/2007 |
| WO | 2008008687 | A1 | 1/2008 |
| WO | 2008036553 | A2 | 3/2008 |
| WO | 2009027662 | A2 | 3/2009 |

OTHER PUBLICATIONS

International Search Report with Written Opinion issued Jun. 2, 2010, for International Patent Application Serial No. PCT/US09/064553, 16 pages.

Halliburton Cementing Casing Equipment and Accessories Product brochure, 2005, 30 pages.

TAM Inflatable Packer Element Selection Product brochure, undated, 4 pages.

World Oil Tools External Casing Packer Product brochure, undated, 4 pages.

Halliburton Fas Drill® TC Bridge and Frac Plugs Product brochure, 2008, 2 pages.

Hunter, Bill, Kulakofsky, David, and Ravi, Kris, Life-of-Well Isolation Takes Intelligence, E&P magazine, Sep. 2007, pp. 77-78, Hart Energy Publishing LP, Houston, Texas.

Protech Centerform Carbon Fiber Composite Centralizers Product brochure, 2006, 2 pages.

Halliburton Delivers Swell Technology Products to Norway, www.rigzone.com, Aug. 25, 2008, 1 page.

Swell Technology Solves Challenges in Difficult Well Completions, www.halliburton.com, Mar. 2006, 6 pages.

Halliburton Swellpacker® Isolation System Product brochure, undated, 1 page.

Halliburton Waterpacker™ Isolation System Product brochure, undated, 1 page.

Halliburton What Does Simplifying Complex Completions Deliver? article, www.halliburton.com/divisions, undated, 1 page.

Hunter, B., Ravi, K., and Kulakofsky, D, Three Key Mechanisms Deliver Zonal Isolation, undated, 11 pages.

U.S. Appl. No. 12/256,063, filed Oct. 22, 2008, 38 pages.

Halliburton LifeCem™ Cements, www.halliburton.com, 2009, 1 page.

Halliburton Fas Drill® SVB Squeeze Packers, www.halliburton.com, 2009, 1 page.

World Oil Tools Inflatable Packer Product brochure, undated, 19 pages.

* cited by examiner

FIG.2
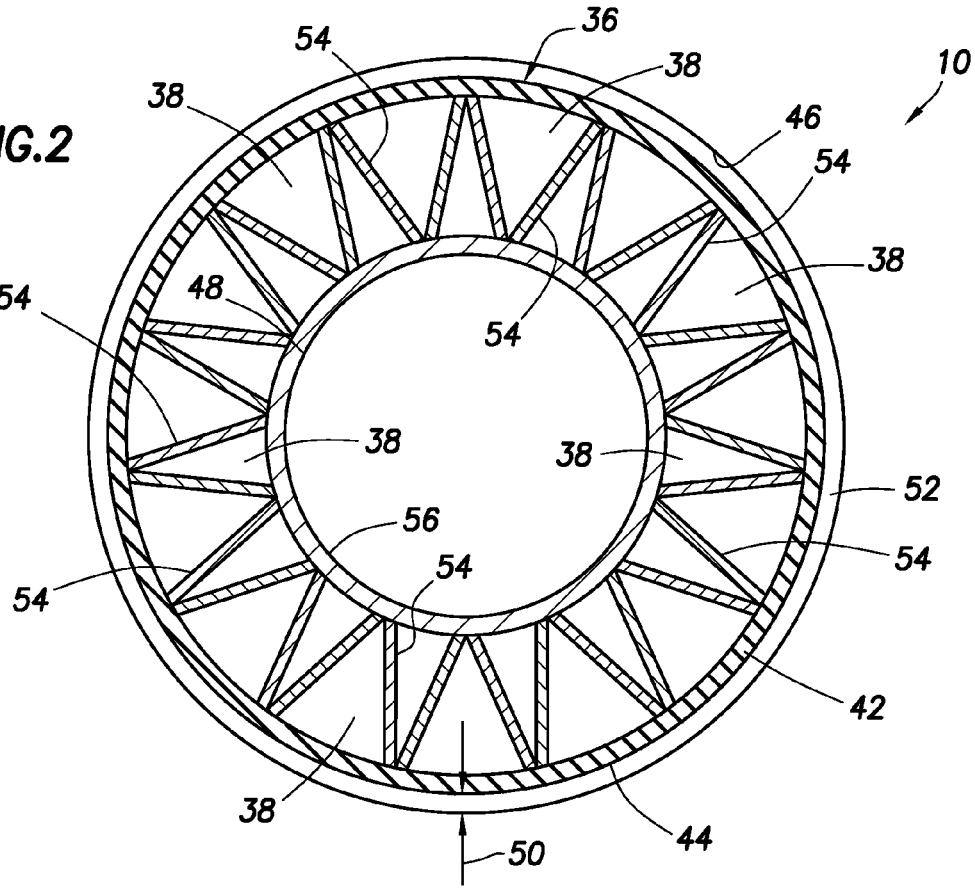
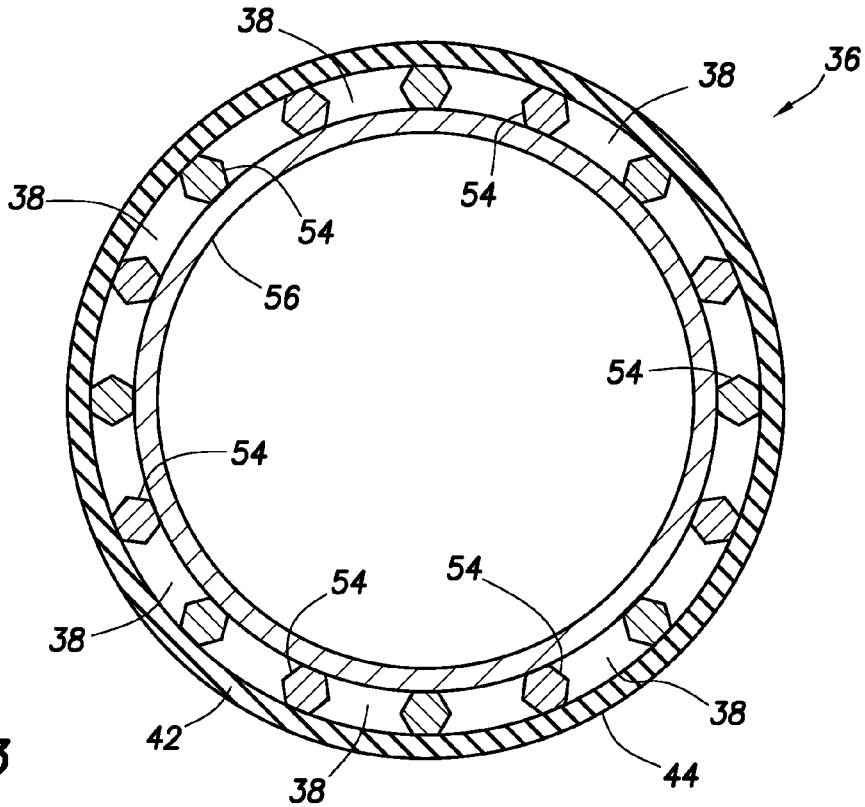
FIG.3

USE OF SWELLABLE MATERIAL IN AN ANNULAR SEAL ELEMENT TO PREVENT LEAKAGE IN A SUBTERRANEAN WELL

BACKGROUND

The present disclosure relates generally to equipment utilized and operations performed in conjunction with a subterranean well and, in an embodiment described herein, more particularly provides for use of swellable material in an annular seal element to prevent leakage in a well.

Leak paths can sometimes arise in cemented intervals due to poor cement bonding to a surrounding earth formation surface, incomplete mud filter cake removal prior to placing cement in the interval, subsidence and compaction. In some circumstances, the cement will not bond properly to the interior surface of an outer casing or formation surface because of incomplete drilling fluid removal from the surface, presence of a filter cake on the surface or a film of drilling mud on the surface. In horizontal wells, a fluid channel may develop on a high side of the wellbore, due to (but not limited to) fluid migrating out of the cement slurry or density differences of the different liquid materials in the wellbore.

In addition, situations can arise in which the cement takes an initial bond to the surface of the casing or wellbore, but then de-bonds (separates) from the surface at some point in the future. These situations can be due to, for example, reservoir subsidence, tectonic plate movement, fluctuating temperatures, fluctuating pressures and changes in wellbore stresses.

When these situations arise, and there is no effective seal along the interval (e.g., in an annulus between two casing strings, or between a casing string and the inner surface of the wellbore), fluids can migrate from one reservoir or zone to another, or to the surface. Uncontrolled flow between reservoirs is often called an "underground blowout" and is highly undesirable. Reservoir fluids (liquids and/or gases) unintentionally flowing to the surface (e.g., between casing strings) is often called "casing pressure." If the pressures exerted by the fluids persist for extended periods, then it is often called "sustained casing pressure."

Currently, there is no completely satisfactory solution to these problems. It is known to use a swellable packer along a cemented interval so that, if the cement leaks, the packer can swell and close off the annulus, but the packer is enclosed in the cement and cannot reliably close off a fluid channel in the cement itself. The swellable element will not seal the channel unless there is direct contact with the channel and the fluid therein. It is also known to mix particles of swellable material in the cement slurry, but this method results in a relatively small effective volume change, which may not be sufficient for sealing off larger leak paths.

Therefore, it will be appreciated that improvements are needed in the art of preventing leakage in a subterranean well.

SUMMARY

In the present specification, well systems and associated methods are provided which solve at least one problem in the art. One example is described below in which a seal element comprising a swellable material provides for channels between the swellable material and a casing string, so that cement can be flowed through the channels and the swellable material can swell and seal against another casing string or a formation surface. Another example is described below in which segments of swellable material are installed in an annulus between two casing strings, so that when the swellable material swells, the segments will close off the annulus and thereby seal between the casing strings.

In one aspect, a method of sealing an annulus formed between a casing string and a surface in a subterranean well is provided. The method includes the steps of: positioning a swellable material in the annulus, with the swellable material being positioned between the casing string and the surface; and flowing cement through at least one channel formed between the swellable material and the casing string.

In another aspect, a well system is provided which includes a casing string positioned in a wellbore; a seal element comprising a swellable material which swells and thereby causes the seal element to seal against a surface in the wellbore; and at least one channel formed between the swellable material and the casing string. Cement is flowed into the channel.

In yet another aspect, a method of sealing an annulus between two casing strings is provided which includes the steps of: providing multiple arcuate segments, each of the segments comprising a swellable material; and installing the segments in the annulus. Each of the segments thereby occupies a respective circumferential portion of the annulus.

In a further aspect, a method of sealing in a subterranean well includes the steps of: positioning an annular seal element comprising a swellable material in the well; and flowing cement into at least one channel formed longitudinally through the seal element.

In a still further aspect, a method of sealing a wellbore inside a casing or wellbore is provided which includes the steps of: shrouding an implement with a seal element comprising a swelling material that contains at least one channel therein, and positioning the implement within the casing or wellbore. The element seals against the casing surface or the earth, and cement is flowed through the channel.

Another aspect comprises a method of sealing an annulus formed between two surfaces in a subterranean well. The method includes the steps of: positioning a seal element comprising a swellable material in the annulus, the swellable material being positioned between the surfaces; and flowing cement through at least one channel formed between the swellable material and one of the surfaces.

A further aspect comprises a method of sealing an annulus formed between a casing string and a surface in a well. The method includes: positioning a seal element in the annulus, a swellable material of the seal element being positioned between the casing string and the surface; and flowing cement through a channel formed between the swellable material and the casing string.

These and other features, advantages and benefits will become apparent to one of ordinary skill in the art upon careful consideration of the detailed description of representative embodiments below and the accompanying drawings, in which similar elements are indicated in the various figures using the same reference numbers.

BRIEF DESCRIPTION OF THE DRAWINGS

FIG. 2 is an enlarged scale schematic cross-sectional view through an annular seal device, taken along line 2-2 of FIG. 1;

FIGS. 3-10 are schematic views of additional configurations of the annular seal device;

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper" , "upward" and similar terms refer to a direction toward the earth's surface along a wellbore, and "below", "lower", "downward" and similar terms refer to a direction away from the earth's surface along the wellbore.

Figure 1:
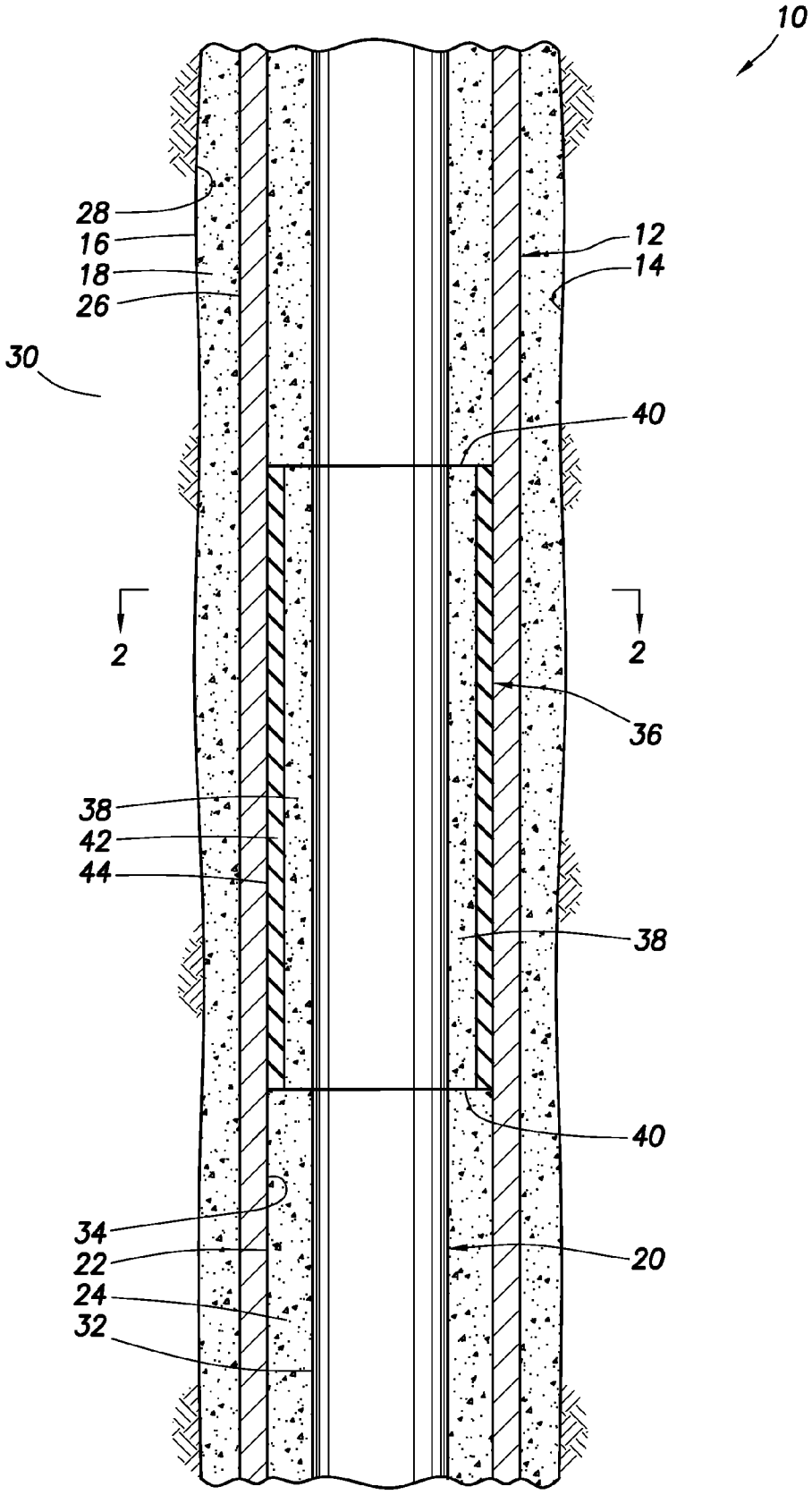
FIG. 1 is a schematic partially cross-sectional view of a well system and associated method embodying principles of the present disclosure.

Representatively illustrated in FIG. 1 is a well system 10 and associated method which embody principles of the present disclosure. In the well system 10, a casing string 12 has been cemented in a wellbore 14 by means of cement 16 flowed into an annulus 18 formed radially between the casing string and the wellbore. Another casing string 20 has been cemented within the casing string 12 by means of cement 22 flowed into an annulus 24 formed radially between the casing strings.

As used herein, the term "casing string" is used to refer to a tubular string used to form a protective lining in a wellbore. A casing string may be of any of those types more precisely known to those skilled in the art as casing, liner, pipe or tubing. Casing strings may be made of various materials (such as steel, other alloys, composites, etc.) and may be segmented, continuous, expanded, formed in situ, etc.

As used herein, the term "cement" is used to refer to an initially flowable material which subsequently hardens to thereby seal and secure a tubular string in a well, or to form a seal or plug in a well. A cement may be composed substantially of cementitious material and/or it may include various other types of materials (such as epoxies, other polymers, elastomers, resinous materials, inert fillers, swellable materials, etc.). Cement may be used to seal an annulus between two tubular strings and/or cement may be used to seal an annulus between a tubular string and a formation surface, or to fill the casing or borehole.

As depicted in FIG. 1, cement 16 seals the annulus 18 between an outer surface 26 of the casing string 12 and a surface 28 of a formation 30 intersected by the wellbore 14. Cement 22 seals the annulus 24 between an outer surface 32 of the casing string 20 and an inner surface 34 of the casing string 12.

Prior to cementing the casing string 20 within the casing string 12, the casing string 20 is conveyed into the casing string 12 with an annular seal device 36 thereon. The annular seal device 36 includes channels 38 therein for flowing the cement 22 through the annulus 24 between opposite longitudinal sides 40 of the device. In addition, the device 36 includes a swellable material 42 in a seal element 44 for sealingly contacting the inner surface 34 of the casing string 12.

Preferably, the seal device 36 is centered within the casing string 12 upon installation. For this purpose, the casing string 20 may be provided with centralizers (not shown) above and/or below the seal device 36. Suitable centralizers are available from but not limited to Halliburton Energy Services, Centek or Protech Centerform.

In another embodiment, the device 36 could be conveyed into the wellbore 14 on the casing string 12. In that case, the channels 38 would provide for flowing the cement 16 through the annulus 18 between the opposite sides 40 of the device 36, and the swellable material 42 would sealingly contact the surface 28 of the formation 30.

In another embodiment, an implement that is shrouded with swellable materials and at least one channel, could be conveyed into the well with casing, tubing, wireline, slickline, coil tubing or by other means available. The implement once deposited in the casing or within the borehole would swell to seal against the surface of the casing or the earth. Cement would then flow through the channel.

Any type of swellable material may be used for the material 42 in the device 36. The term "swell" and similar terms (such as "swellable") are used herein to indicate an increase in volume of a material. Typically, this increase in volume is due to incorporation of molecular components of the fluid into the swellable material itself, but other swelling mechanisms or techniques may be used, if desired. Note that swelling is not the same as expanding, although a material may expand as a result of swelling.

For example, in some conventional packers, a seal element may be expanded radially outward by longitudinally compressing the seal element, or by inflating the seal element. In each of these cases, the seal element is expanded without any increase in volume of the material of which the seal element is made. Thus, in these conventional packers, the seal element expands, but does not swell.

The fluid which causes swelling of the swellable material 42 could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material 42 could be delayed until the material is positioned downhole where a predetermined elevated temperature exists.

The fluid could cause swelling of the swellable material 42 due to passage of time. The fluid which causes swelling of the material 42 could be naturally present in the well, or it could be conveyed with the annular seal device 36, conveyed separately or flowed into contact with the material 42 in the well when desired. Any manner of contacting the fluid with the material 42 may be used in keeping with the principles of the present disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

As another alternative, the swellable material 42 may have a substantial portion of cavities therein which are compressed or collapsed at the surface condition. Then, after being placed in the well at a higher pressure, the material 42 is expanded by the cavities filling with fluid.

This type of apparatus and method might be used where it is desired to expand the material 42 in the presence of gas rather than oil or water. A suitable swellable material is described in U.S. Published Application No. 2007-0257405, the entire disclosure of which is incorporated herein by this reference.

Preferably, the swellable material 42 used in the device 36 swells by diffusion of hydrocarbons into the swellable material, or in the case of a water swellable material, by the water being absorbed by a super-absorbent material (such as cellulose, clay, etc.) and/or through osmotic activity with a salt like material. Hydrocarbon-, water- and gas-swellable materials may be combined in the seal element 44 of the device 36, if desired.

It should, thus, be clearly understood that any type or combination of swellable material which swells when contacted by any type of fluid may be used in keeping with the principles of this disclosure. Swelling of the material 42 may be initiated at any time, but preferably the material swells at least after the device 36 is installed in the well.

Swelling of the material 42 may be delayed, if desired. For example, a membrane or coating may be on any or all surfaces of the material 42 to thereby delay swelling of the material. The membrane or coating could have a slower rate of swelling, or a slower rate of diffusion of fluid through the membrane or coating, in order to delay swelling of the material 42. The membrane or coating could have reduced permeability or could break down in response to exposure to certain amounts of time and/or certain temperatures. Suitable techniques and arrangements for delaying swelling of a swellable material are described in U.S. Pat. No. 7,143,832 and in U.S. Published Application No. 2008-0011473, the entire disclosures of which are incorporated herein by this reference.

Referring additionally now to FIG. 2, an enlarged scale schematic cross-sectional view of the annular seal device 36 is representatively illustrated apart from the remainder of the well system 10 for clarity of illustration and description. In this view it may be seen that the device 36 is carried on a generally cylindrical outer surface 48 (such as the outer surface 32 of the casing string 20 or the outer surface 26 of the casing string 12) and is used to seal against a generally cylindrical inner surface 46 (such as the inner surface 34 of the casing string 12 or the surface 28 of the formation 30).

A radial gap 50 exists initially between the seal element 44 and the surface 46 when the device 36 is installed in the well. However, when contacted by the fluid as described above, the swellable material 42 swells and the gap 50 is closed off, thereby sealing off an annulus 52 (such as the annulus 18 or the annulus 24).

The channels 38 are formed between multiple supports 54 extending generally radially between the seal element 44 and an inner generally cylindrical sleeve 56. The sleeve 56 is used to attach the device 36 to a casing string (such as the casing string 12 or the casing string 20). Welding, bonding, vulcanization, set screws or other attachment means may be used as desired. In some embodiments, the sleeve 56 may not be necessary.

The supports 54 in the example of FIG. 2 serve to space apart the seal element 44 from the surface 48. The outer ends of adjacent pairs of the supports 54 converge in a radially outward direction, and inner ends of adjacent pairs of the supports converge in a radially inward direction, thereby forming a strong, triangulated structure for outwardly supporting the seal element 44.

The supports 54 may be made of any material or combination of materials. For example, the supports 54 may be made of metal, elastomer, polymer or a composite material, and in an example described below, the supports may be made of the swellable material 42. Furthermore, the supports 54 may be integrally formed with either or both of the seal element 44 and the sleeve 56.

Figure 2A:
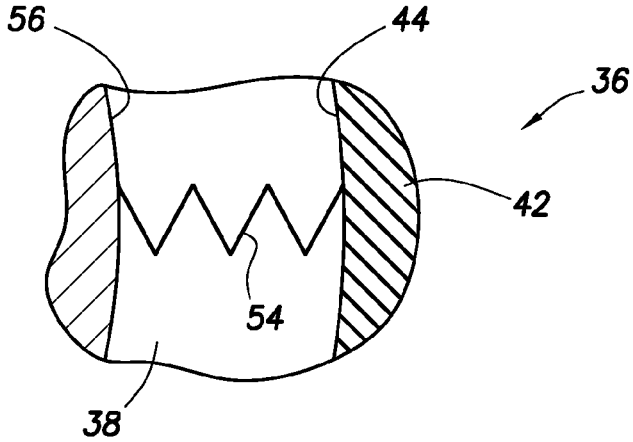
FIGS. 2A-C are further enlarged scale schematic cross-sectional views of support configurations which may be used in the annular seal device of FIG. 2.
Figure 2B:
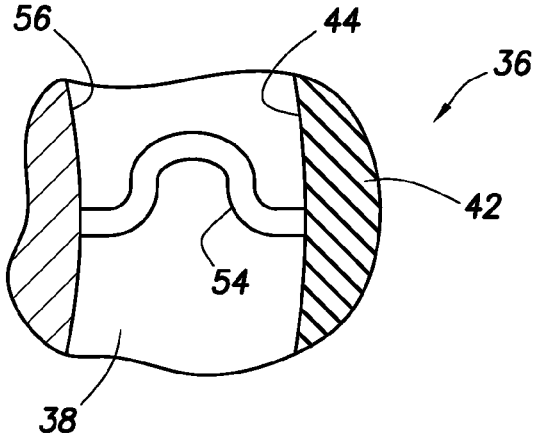
Figure 2C:
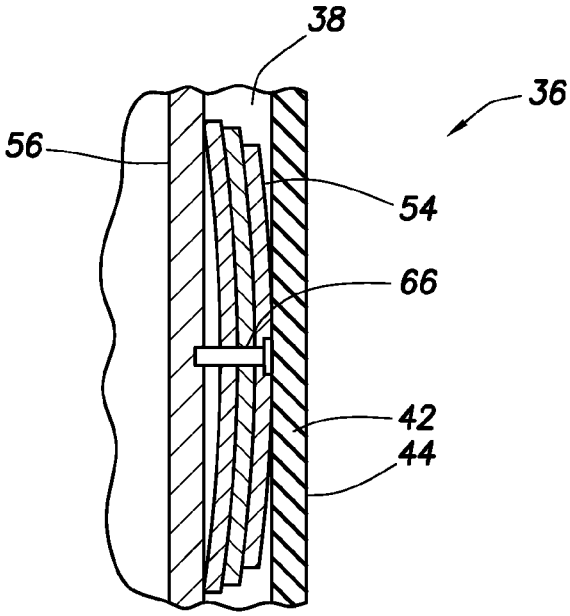

Various additional configurations of the supports 54 are representatively illustrated in FIGS. 2A-C. These additional configurations not only space the seal element 44 radially apart from the sleeve 56 or surface 48, but also bias the seal element radially outward toward the surface 46 (e.g., toward the inner surface 34 of the casing string 12 or the surface 28 of the formation 30).

In FIG. 2A, a support 54 is depicted which comprises a spring or another type of biasing device (for example, a spring-loaded elastomer, etc.). The support 54 may continuously bias the seal element 44 radially outward, or it may be configured to bias the seal element outward upon passage of a certain amount of time, exposure to a predetermined temperature, exposure to a certain fluid or chemical downhole, etc.

In FIG. 2B, a support 54 is depicted which comprises a shape memory material. The support 54 is deformed to a compressed configuration at the surface (as shown in FIG. 2B), and later when the support is exposed to a predetermined elevated downhole temperature, the support will resume its pre-deformation elongated configuration, thereby biasing the seal element 44 radially outward. Suitable shape memory materials include shape memory metals (such as NITINOL™, etc.) and shape memory elastomers (such as poly (glycerol-sebacate) elastomer and certain polyurethane elastomers, etc.).

In FIG. 2C, a support 54 comprises multiple bow or leaf springs retained in a compressed configuration by a fastener 66 which includes a eutectic material. At a predetermined downhole temperature, the eutectic material will melt, thereby releasing the springs to radially outwardly bias the seal element 44.

Note that many other configurations of the supports 54 may be designed to bias the seal element 44 outward upon passage of a certain amount of time, exposure to a predetermined temperature, exposure to a certain fluid or chemical downhole, etc. Thus, it will be appreciated that the principles of this disclosure are not limited to use of only the supports 54 described herein.

Referring additionally now to FIGS. 3-10, additional configurations of the annular seal device 36 are representatively illustrated, apart from the well system 10. These additional configurations demonstrate that a large variety of different embodiments are possible utilizing the principles of this disclosure, and those principles are not limited in any way to the particular details of any of the configurations described herein.

In FIG. 3, the supports 54 are in the form of rods having a hexagonal cross-sectional shape. The rod supports 54 may be attached to the exterior of the sleeve 56, with the seal element 44 overlying and being suspended between the supports.

Figure 4:
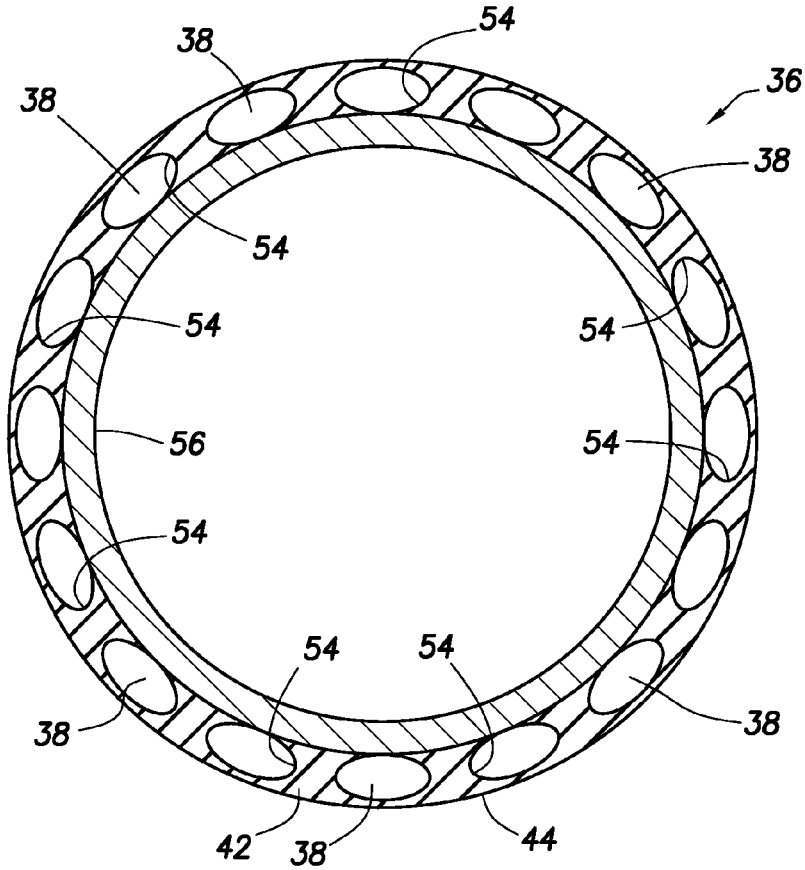

In FIG. 4, the supports 54 are integrally formed with the seal element 44 as a single structure. The oval-shaped channels 38 are, thus, formed through the seal element 44.

In this example, the supports 54 are constructed of the swellable material 42. When the material 42 swells, the channels 38 may be closed off, to thereby provide enhanced isolation of the annulus 52 between the opposite sides 40 of the seal device 36, and the seal element 44 will in effect be biased toward the surface 48 by swelling of the supports 54.

Figure 5:
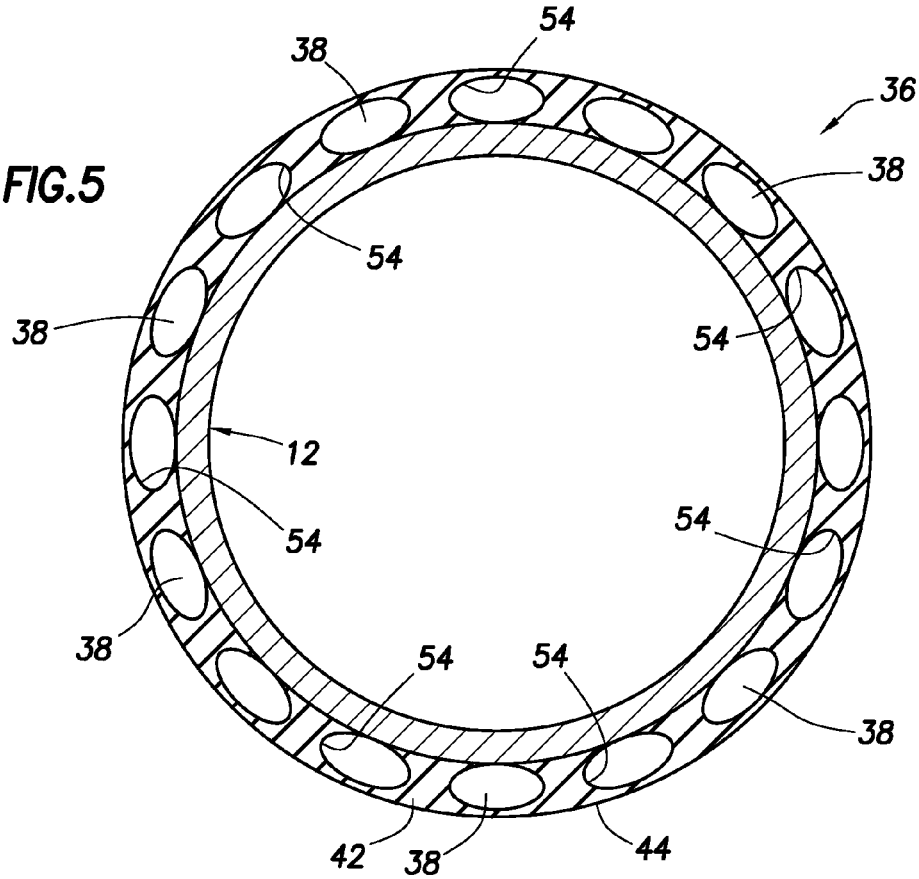

In FIG. 5, the configuration of the seal device 36 is similar in most respects to the configuration of FIG. 4. However, in the configuration of FIG. 5, the sleeve 56 is not used. Instead, the seal element 44 is attached (e.g., by bonding, molding, vulcanization, etc.) directly to a tubular string, such as the casing string 12 or 20, or to a solid body implement. Thus, it should be appreciated that the sleeve 56 is not necessary in any of the other configurations of the seal device 36 described herein.

Figure 6:
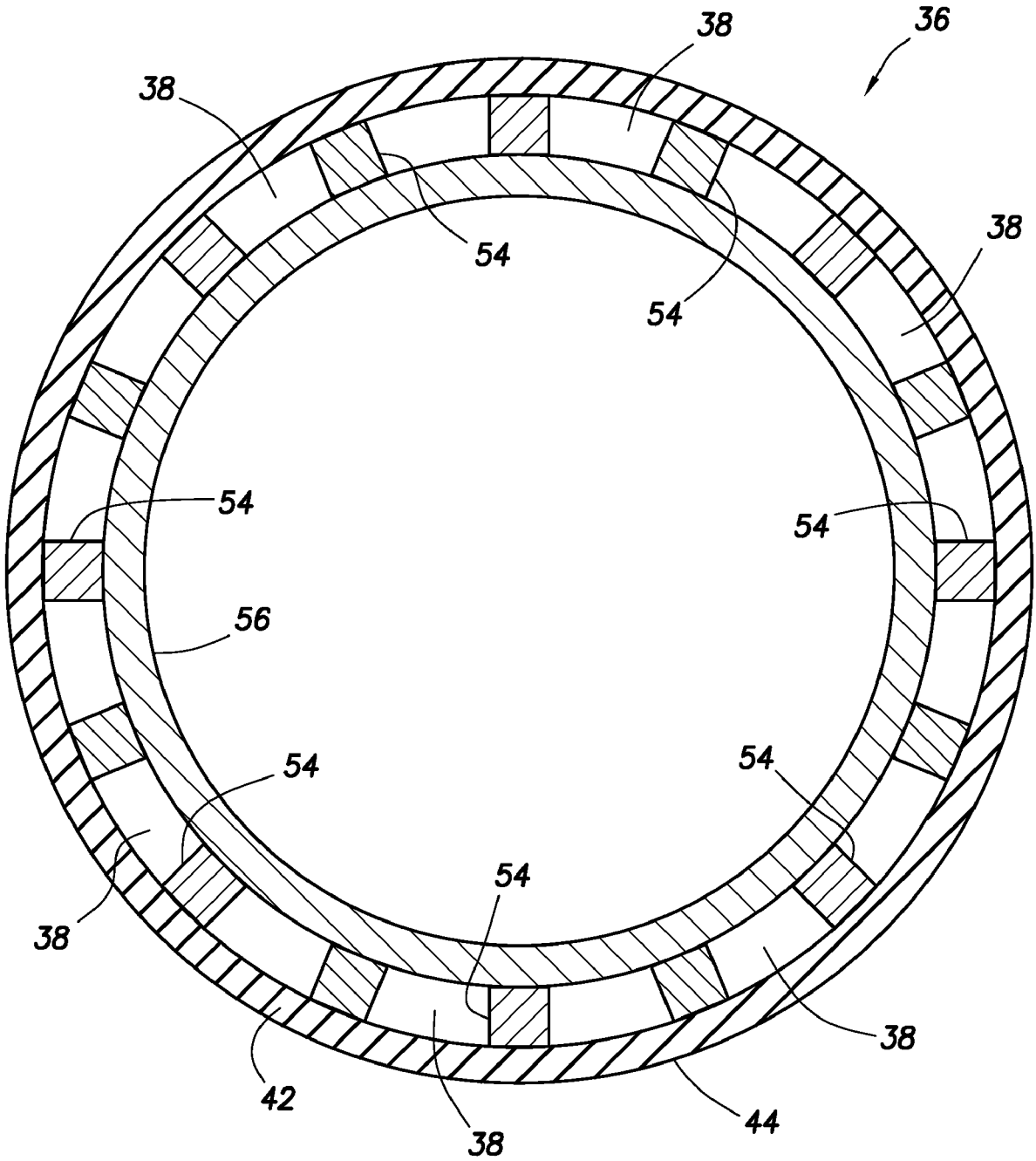

In FIG. 6, the configuration of the seal device 36 is similar in most respects to the configuration of FIG. 3. However, in the configuration of FIG. 6, the supports 54 have a rectangular or square cross-sectional shape.

Figure 7:
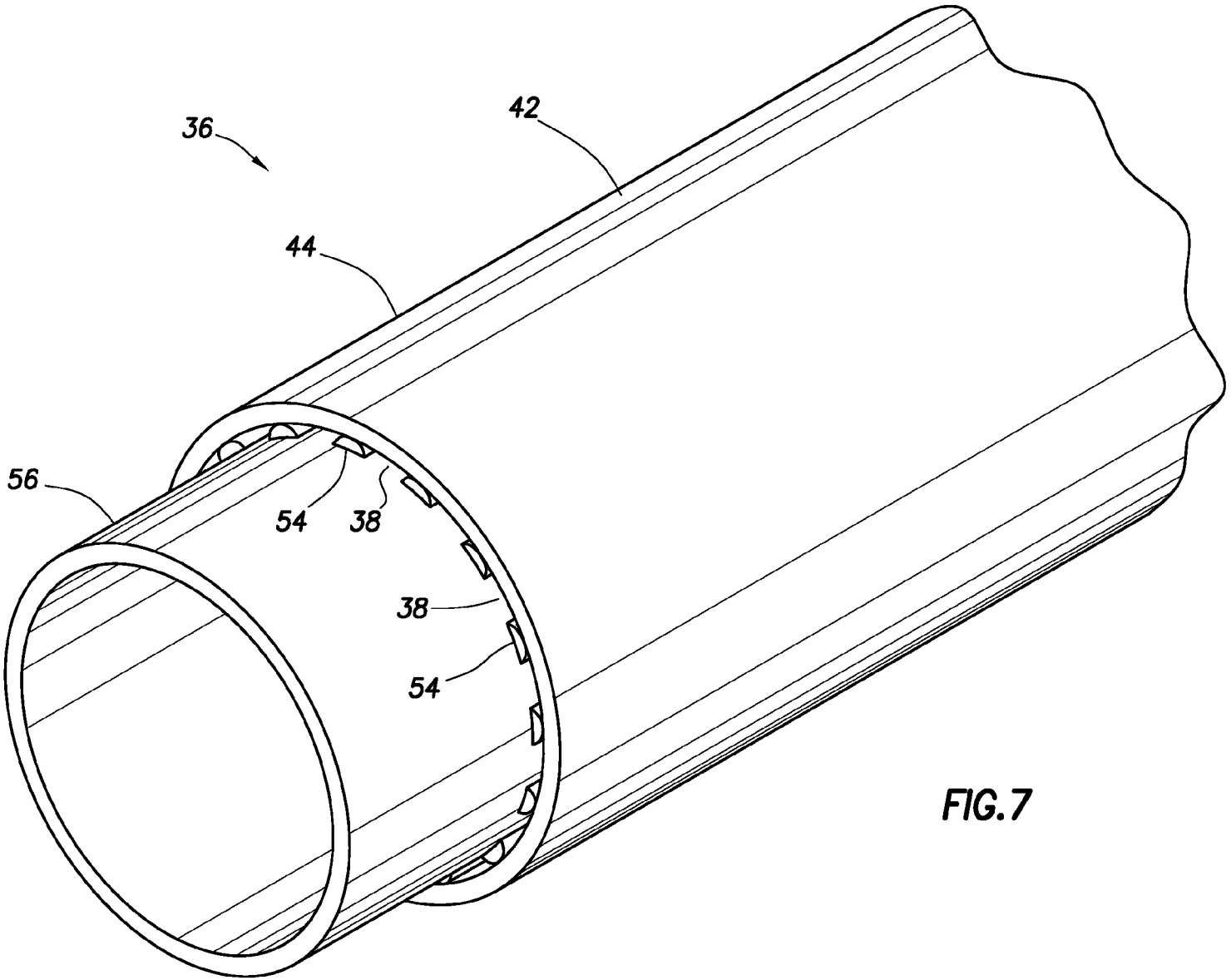
Figure 8:
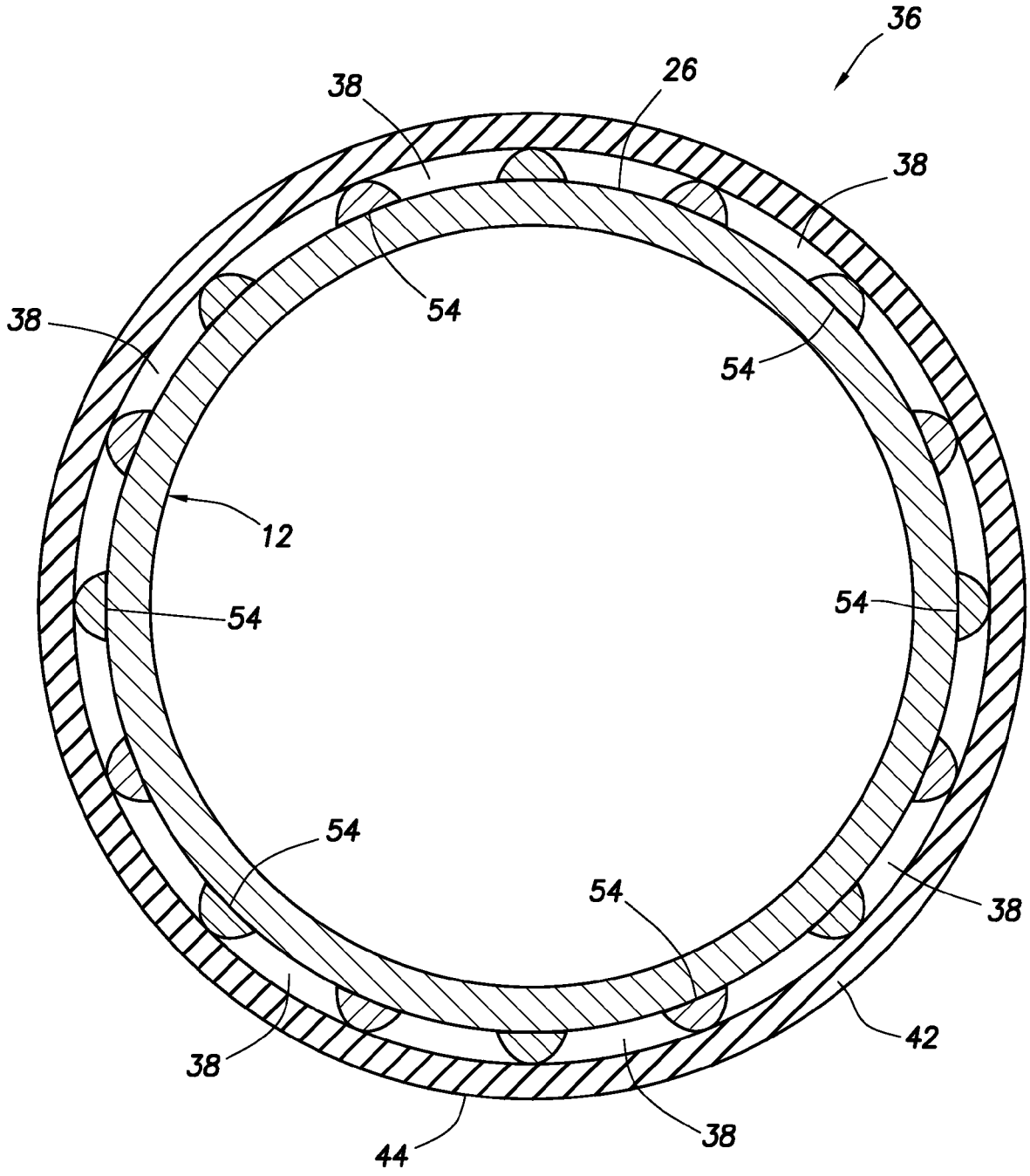

In FIG. 7, the supports 54 have a semi-circular cross-sectional shape. In FIG. 8, the configuration of the seal device 36 is similar to that of FIG. 7, except that the supports 54 are attached directly to the outer surface 26 of the casing string 12. This method of attachment may be the same as, or similar to, the manner in which centralizing ribs are attached externally to casing string sections to form centralizers, such as those available from Protech Centerform, Inc. of Houston, Tex. USA.

Figure 9:
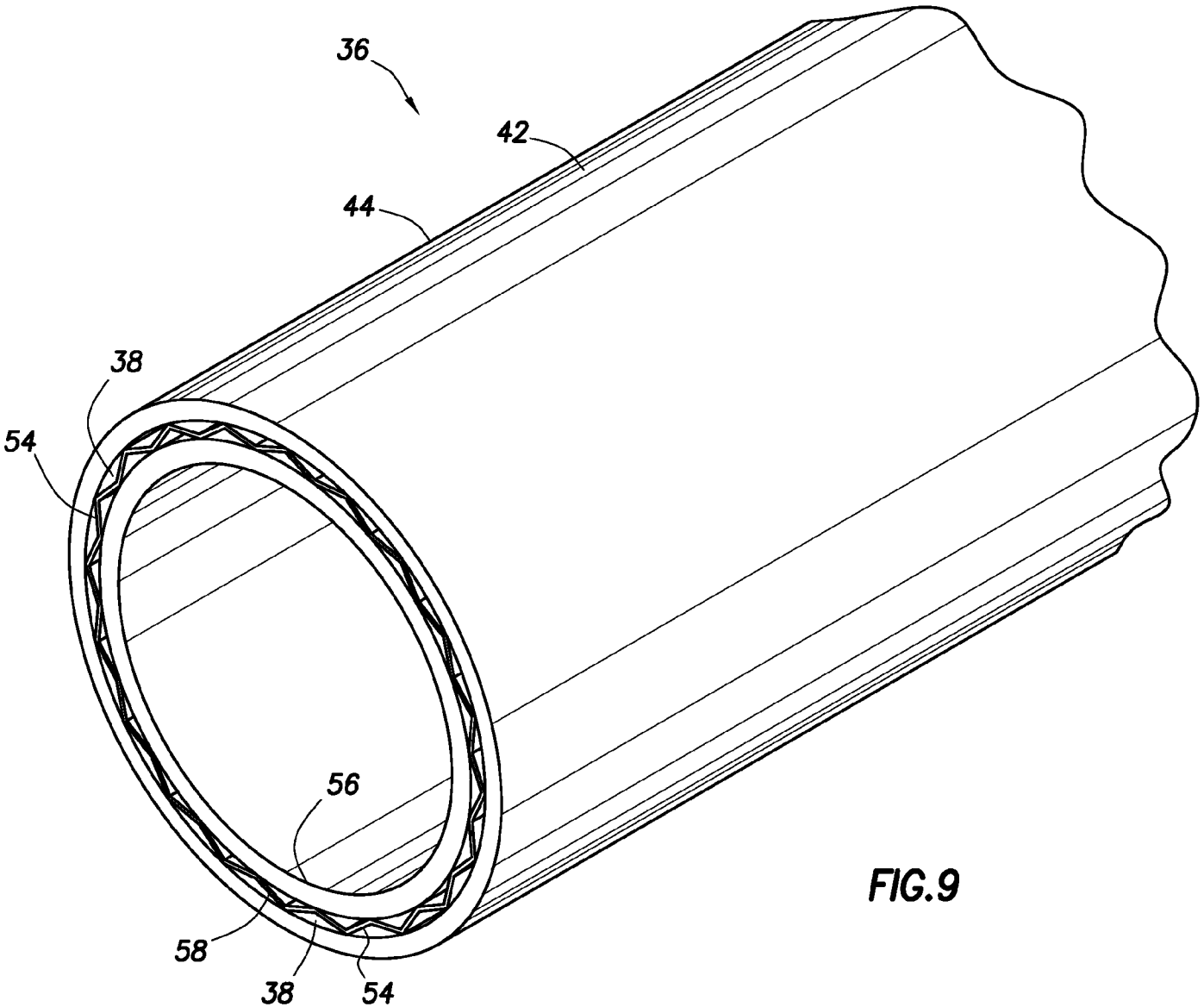

In FIG. 9, the supports 54 are formed as integral parts of a corrugated structure 58 secured about the sleeve 56. The seal element 44 overlies the structure 58 and is suspended between the supports 54.

Figure 10:
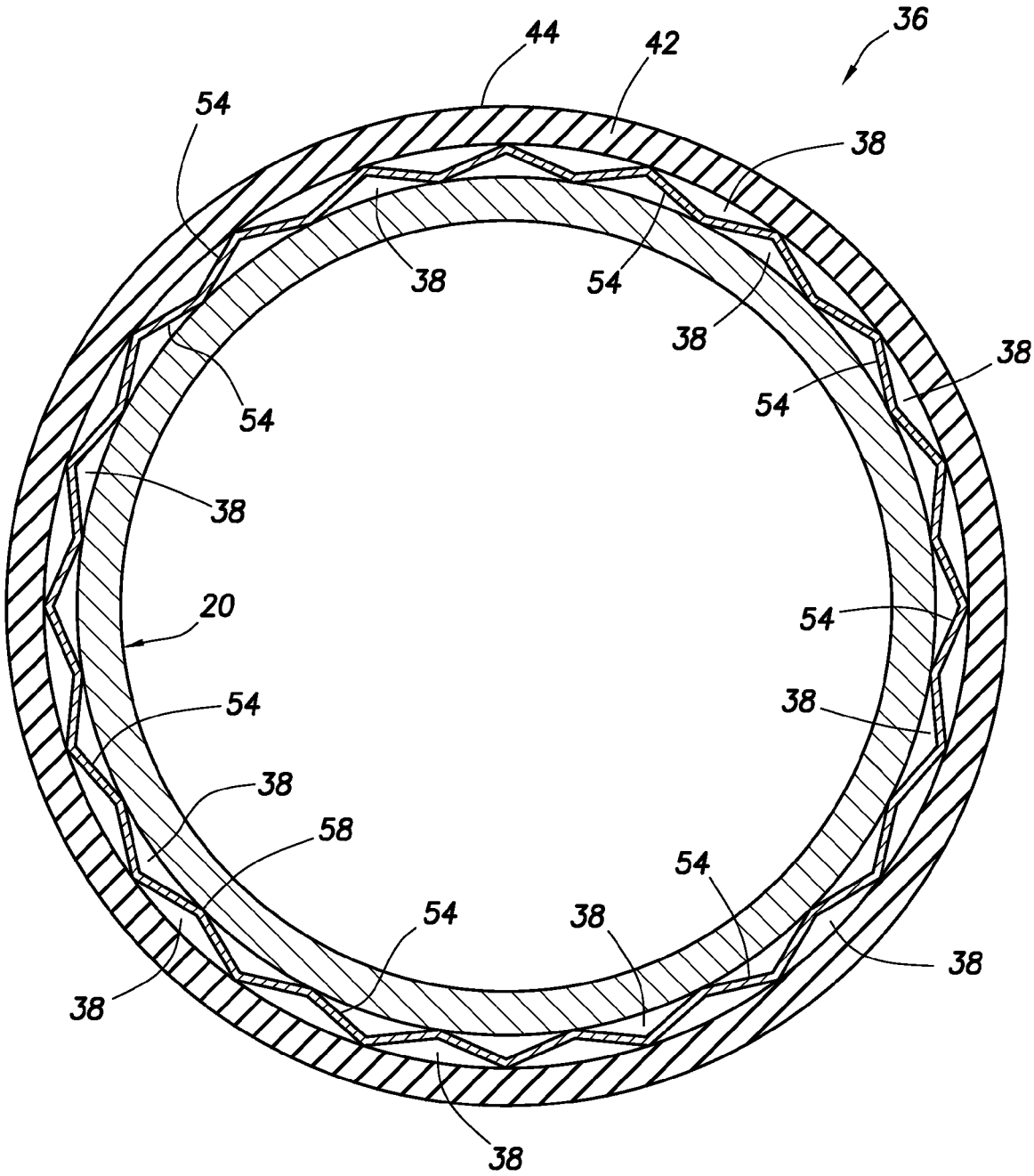

The configuration of FIG. 10 is similar to the configuration of FIG. 9 in most respects, except that the sleeve 56 is not used. Instead, the structure 58 and seal element 44 are attached to the casing string 20 without use of the sleeve 56.

Figure 11:
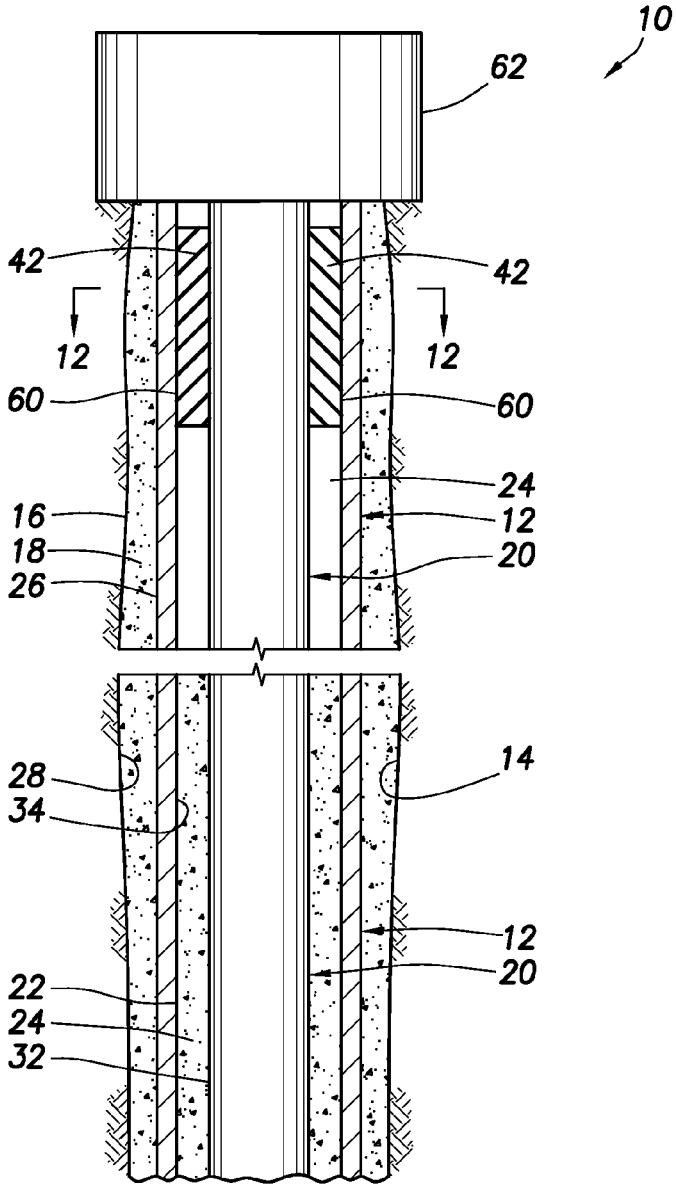
FIG. 11 is a schematic partially cross-sectional view of another configuration of the well system and associated method which embodies principles of the present disclosure.
Figure 12:
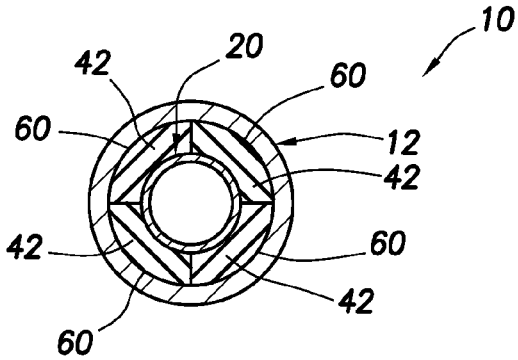
FIG. 12 is an enlarged scale schematic cross-sectional view through an annular seal device, taken along line 12-12 of FIG. 11.

Referring additionally now to FIGS. 11 & 12, the well system 10 and associated method are representatively illustrated with additional features which enhance sealing of the annulus 24 between the casing strings 12, 20 and thereby prevent formation fluids from flowing to the surface or pressurizing the annulus at the surface. Specifically, multiple segments 60 comprising swellable material 42 are positioned in the annulus 24 near the surface. When the material 42 swells, the annulus 24 is positively sealed off below a wellhead 62 connected to the casing strings 12, 20.

As depicted in FIG. 12, four of the segments 60 are used, and the segments have swollen to seal off the annulus 24. The segments 60 each have an arcuate cross-sectional shape to conform to a respective portion of the annulus 24. However, any number and/or shape of the segments 60 may be used as desired.

The use of multiple segments 60 is beneficial, in that it allows the segments to be conveniently installed in the annulus 24. A ledge, shoulder or other type of supporting device or methodology (not shown) may be used to support the segments 60 in the annulus 24 until the segments are swollen.

In actual practice, the cement 22 would be flowed between the casing strings to seal and secure the casing string 20 in the casing string 12. The segments 60 can then be installed so as to reside above the top of the cement 22. The wellhead 62 would then be installed on the casing strings 12, 20.

A methodology for utilizing the segments 60 for existing wells with leak paths would be to install the segments 60 in the annulus 24, the wellhead 62 would be removed, and the segments would be individually or simultaneously installed in the annulus about the casing string 12.

The wellhead 62 would then be re-installed. Prior to or after re-installing the wellhead 62, an appropriate fluid may be delivered into the annulus 24 to contact the segments 60 and initiate swelling of the material 42. Alternatively, fluid already present in the annulus 24 may be used to cause swelling of the material 42. This may be the same fluid (e.g., formation fluid, etc.) which otherwise would flow to the surface via the annulus 24.

Figure 13:
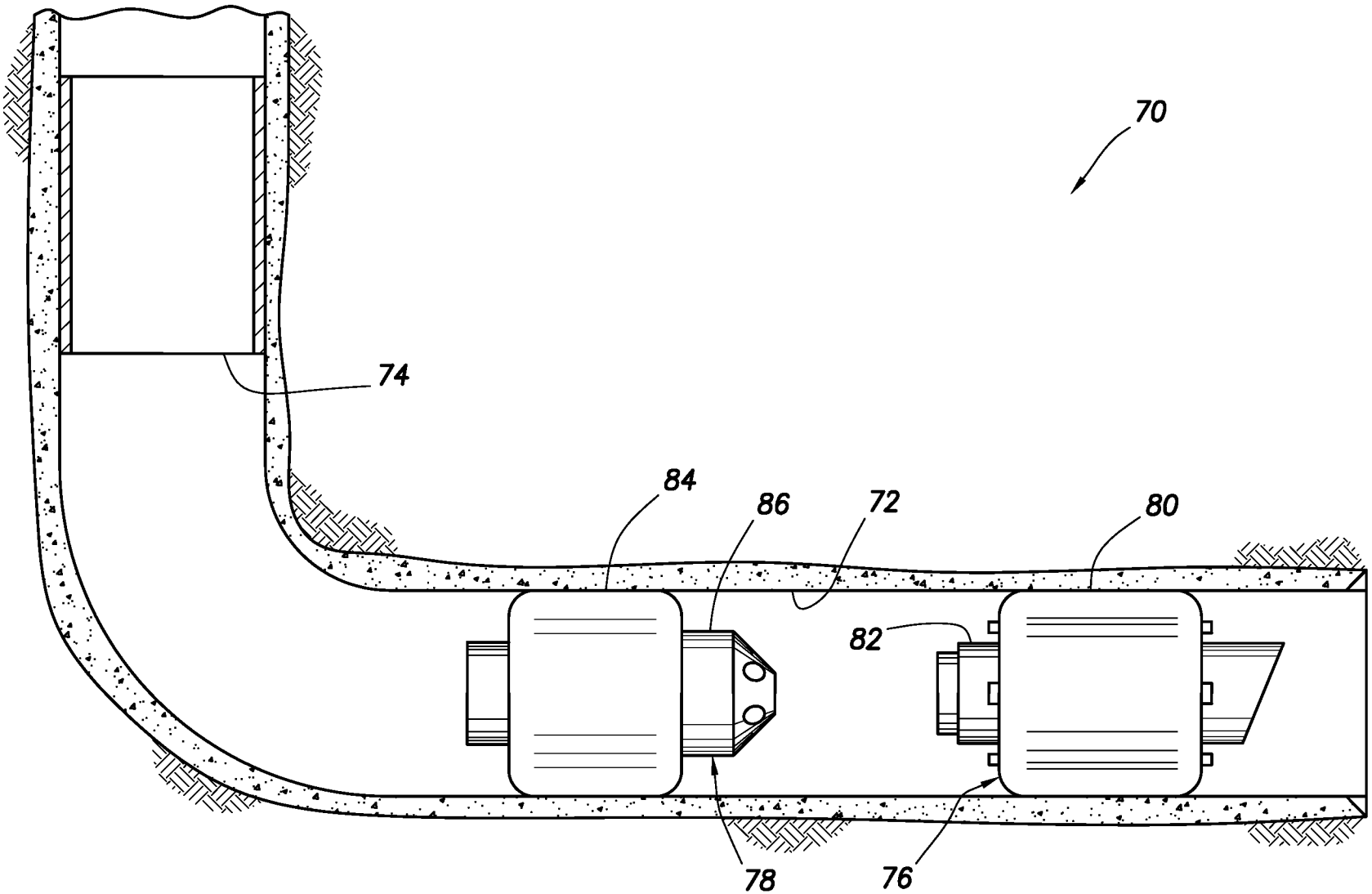
FIG. 13 is a schematic partially cross-sectional view of another well system and associated method embodying principles of the present disclosure.

Referring additionally now to FIGS. 13-16, another well system 70 and associated method are representatively illustrated. In the system 70, it is desired to plug a lateral or generally horizontal wellbore 72. The portion of the wellbore 72 to be plugged may be either cased (as depicted in FIG. 13), or it may be uncased or open hole.

In this example, a casing patch 74 has been previously installed uphole from the portion of the wellbore 72 to be plugged, and so access to the wellbore below the casing patch is restricted. The use of swellable material in the plug and packer described below enables them to pass through the restriction, and later sealingly engage the inner surface of the wellbore 72. However, it should be understood that the casing patch 74 or another restriction is not necessarily present in well systems and methods incorporating principles of the present disclosure.

As depicted in FIG. 13, a plug 76 and a packer 78 have been positioned in the wellbore 72. The plug 76 and packer 78 may be installed using conventional methods, such as conveying them via wireline, slickline, coiled tubing, etc. Preferably, the plug 76 and packer 78 are spaced apart at the portion of the wellbore 72 which is to be plugged.

The plug 76 includes an annular seal device 80 thereon which is specially designed to seal between the wellbore 72 and a body 82 of the plug. The body 82 may be similar to a conventional body of a bridge plug, such as the FASDRILL™ TC bridge plug available from Halliburton Energy Services, Inc. of Houston, Tex. USA. However, the seal device 80 includes a seal element which comprises a swellable material (e.g., similar to the swellable material 42 described above), with channels extending through the seal element, as described more fully below.

The packer 78 includes an annular seal element 84 which is specially designed to seal between the wellbore 72 and a body 86 of the packer. The packer body 86 may be similar to a conventional body of a packer, such as the FASDRILL™ SVB squeeze packer available from Halliburton Energy Services, Inc. of Houston, Tex. USA. The seal element 84 comprises a swellable material (e.g., similar to the swellable material 42 described above).

If the fluid which causes the swellable material of the plug 76 and packer 78 to swell is not already present in the wellbore 72, then it can be spotted about the plug and packer at the time they are positioned in the wellbore. In this manner, the seal device 80 and seal element 84 will swell, so that they sealingly engage the interior surface of the wellbore 72 (either the surface of a formation surrounding the wellbore if the wellbore is uncased, or an inner surface of casing if the wellbore is cased).

Figure 14:
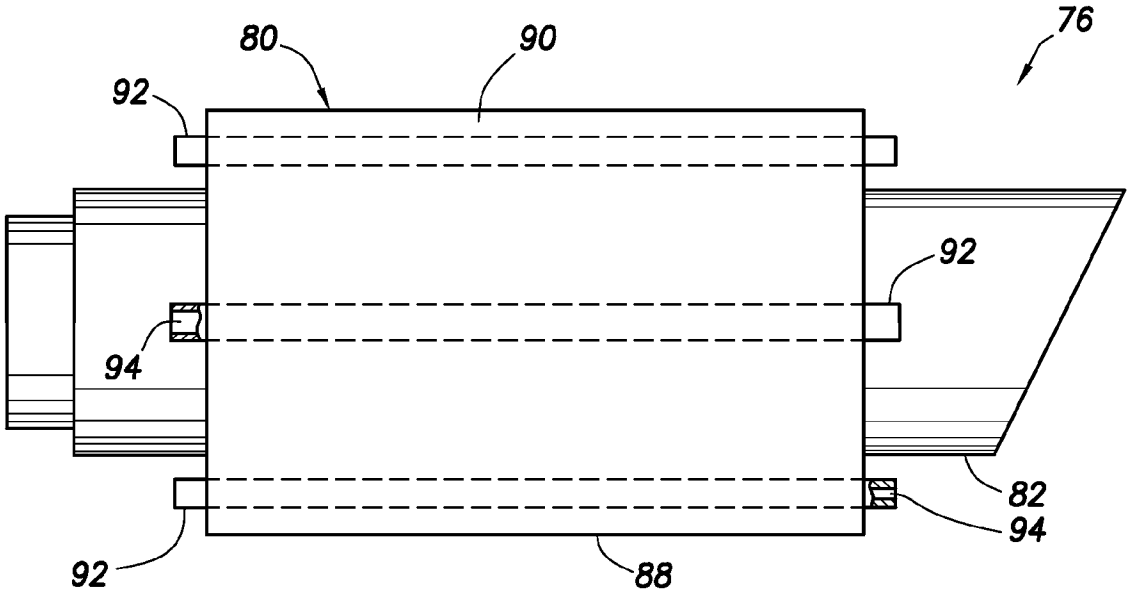
FIG. 14 is an enlarged scale schematic elevational view of a plug comprising an annular seal device usable in the system and method of FIG. 13.

In FIG. 14, a somewhat enlarged scale view of the plug 76 is representatively illustrated. In this view it may be seen that the seal device 80 includes an annular seal element 88 which comprises a swellable material 90. The swellable material 90 may be the same as, or similar to, the swellable material 42 described above.

In addition, multiple tubular conduits 92 extend longitudinally through the seal element 88. Preferably, there are four of the conduits 92 equally circumferentially spaced apart in the seal element 88, but other numbers and spacings of conduits may be used as desired. The conduits 92 are preferably of the type known to those skilled in the art as ¼-inch (6.35 mm) control line commonly used as a hydraulic conduit in wells, but other types of conduits may be used if desired.

The conduits 92 provide channels 94 (similar to the channels 38 described above) through the seal element 88. Thus, the seal device 80 may be used in place of any of the seal devices 36 described above.

In one manner of constructing the seal element 88, the swellable material 90 may be wrapped about the body 82. The conduits 92 may be interposed between successive wraps of the swellable material 90. Alternatively, the swellable material 90 could be molded onto the body 82, with the conduits 92 molded in the seal material. As another alternative, the seal element 88 could be molded with the conduits 92 therein, and then the seal element could be bonded or otherwise secured onto the body 82. However, any method of constructing the seal element 88 may be used in keeping with the principles of this disclosure.

Figure 15:
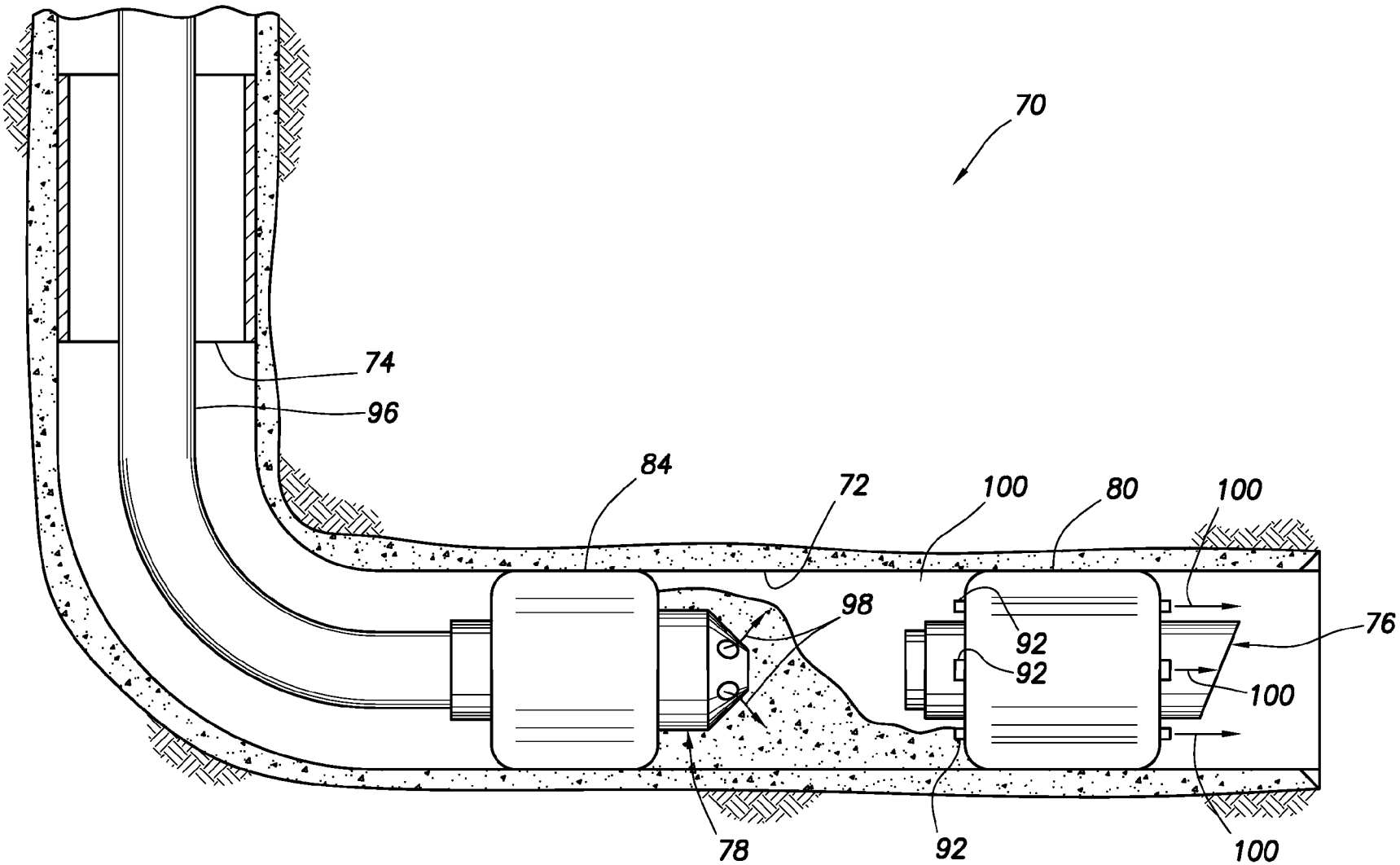
FIG. 15 is a schematic partially cross-sectional view of the well system and method of FIG. 13 after additional steps of the method have been performed.

Referring additionally now to FIG. 15, the system 70 is depicted after a tubular string 96 has been engaged with the packer 78. The tubular string 96 is used to pump cement 98 through the packer 78 and into the space between the packer and the plug 76.

Note that the cement 98 is more dense than the fluid 100 initially present in the space between the plug 76 and the packer 78. Since the wellbore 72 is deviated from vertical, the cement 98 will tend to flow to the low side of the wellbore, and the fluid 100 will tend to remain at the high side of the wellbore. In conventional well plugging operations, this situation can result in a leak path being left at the high side of the wellbore. However, the system 70 includes features which prevent such a leak path from being left at the high side of the wellbore 72, by ensuring that the entire space between the plug 76 and the packer 78 is filled with the cement 98.

Note that the fluid 100 escapes from the space between the plug 76 and the packer 78 via the channels 94 in the conduits 92 as the cement 98 flows into the space. Since the cement 98 will flow first to a lowermost one of the conduits 92, the channel 94 in this lowermost conduit will be the first to have the cement flowed into it, and eventually become plugged by the cement.

The fluid 100 will still be able to escape from the space between the plug 76 and the packer 78 via the higher conduits 92, but eventually, the higher conduits will each have cement 98 flowed into them, and the channels 94 therein will become plugged. In this manner, as the level of the cement 98 in the wellbore 72 rises, the fluid 100 is allowed to escape from the space between the plug 76 and the packer 78, but the conduits 92 are plugged in succession from lowermost to highest. Eventually, the entire space between the plug 76 and the packer 78 is completely filled with the cement 98.

Figure 16:
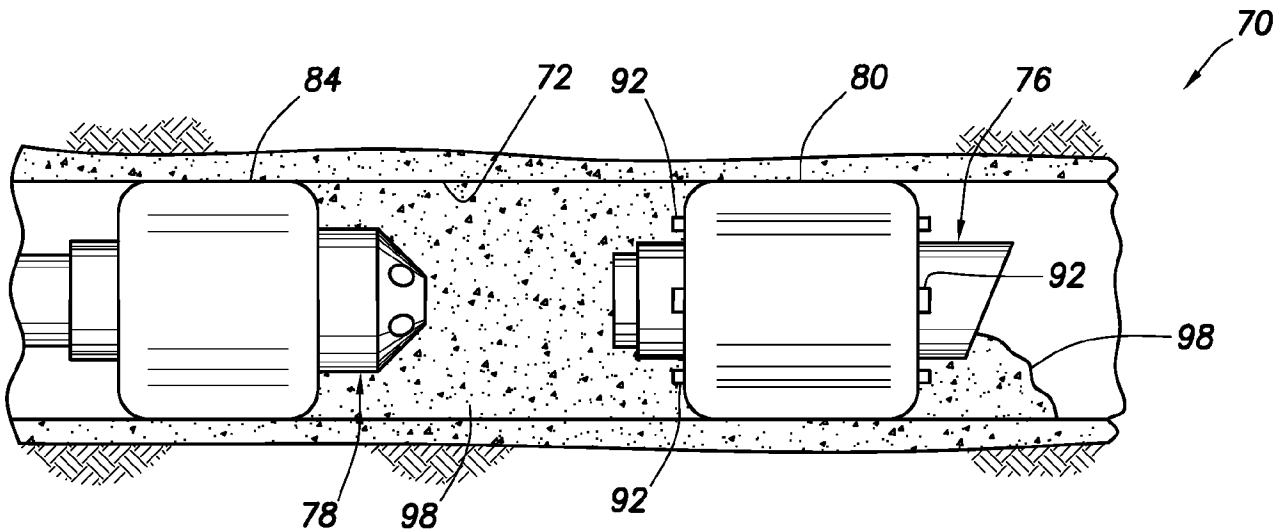
FIG. 16 is an enlarged scale partially cross-sectional view of the well system and method after further steps of the method have been performed.

In FIG. 16 it may be seen that the fluid 100 has been completely evacuated from the space between the plug 76 and the packer 78, with the cement 98 taking its place. Some of the cement 98 may flow completely through the conduits 92 into the wellbore 72 below the plug 76, but it is expected that this will be only a minimal amount.

A valve (not shown) in the packer 78 will be closed, and the cement 98 will be allowed to harden. The swellable material 90 in the seal elements 84, 88 ensure that the cement 98 is contained in the space between the plug 76 and the packer 78. Thus, a secure and effective plug is formed in the wellbore 72.

It may now be fully appreciated that the above disclosure provides many advancements to the art of preventing leakage past a cemented interval, and otherwise providing for sealing an annulus, in a well. The systems and methods described above permit enhanced sealing of cemented intervals and annuli between casing strings, and between a casing string and a wellbore, to thereby prevent leakage of fluids. These systems and methods are convenient and reliable in practice, and economical to construct and deploy.

In particular, the above disclosure provides a method of sealing in a subterranean well, in which the method includes the steps of: positioning an annular seal element 44, 88 comprising a swellable material 42, 90 in the well; and flowing cement 16, 22, 98 into at least one channel 38, 94 formed longitudinally through the seal element 44, 88.

The method may include the step of permitting the swellable material 42, 90 to swell, whereby the seal element 44, 88 contacts and seals against a surface 46 in the well.

The swellable material 42, 90 may swell and the seal element 44, 88 may seal against the surface 46 after the cement flowing step.

The surface may comprise at least one of a surface 34 of a casing string 12, and a surface 28 of an earth formation 30.

The cement flowing step may also include flowing the cement 16, 22, 98 between opposite sides of the seal element 44, 88 via the channel 38, 94.

The cement flowing step may also include displacing a fluid 100 out of a space formed between a plug 76 and a packer 78 as the cement 98 fills the space. Multiple channels 94 may be formed longitudinally through the seal element 88, and the cement flowing step may include successively plugging the channels 94 with the cement 98 as a level of the cement 98 rises in the space.

Also provided by the above disclosure is a method of sealing an annulus 24 between two casing strings 12, 20. The method includes the steps of: providing multiple arcuate segments 60, with each of the segments 60 comprising a swellable material 42; and installing the segments 60 in the annulus 24, each of the segments 60 thereby occupying a respective circumferential portion of the annulus 24.

The installing step may include removing a wellhead 62 from the casing strings 12, 20 prior to inserting the segments 60 in the annulus 24, and then re-attaching the wellhead 62 to the casing strings 12, 20 after inserting the segments 60 in the annulus 24.

The method may include the step of permitting the segments 60 to swell, whereby the segments 60 seal the annulus 24 between the casing strings 12, 20. The method may also include the step of contacting the segments 60 with a fluid to thereby cause the segments 60 to swell.

The method may include the step of flowing cement 22 into the annulus 24 between the casing strings 12, 20.

The above disclosure also describes a well system 10 which includes a casing string 12 or 20 positioned in a wellbore 14; a seal element 44 comprising a swellable material 42 which swells and thereby causes the seal element 44 to seal against a surface 46 in the wellbore 14; and at least one channel 38 formed between the swellable material 42 and the casing string 12, 20, with cement 16 or 22 flowed into the channel 38.

The surface 46 may be formed on another casing string 12. The second casing string 12 may be external to the first casing string 20.

The surface 46 may be formed on an earth formation 30 intersected by the wellbore 14.

The cement 16, 22 may be continuous from a longitudinal side 40 of the seal element 44 through the channel 38 and to an opposite longitudinal side 40 of the seal element 44.

The swellable material 42 may be spaced apart from the casing string 12, 20 by multiple supports 54, with the channel 38 being formed between the supports 54. The supports 54 may be constructed of the swellable material 42. The supports 54 may be formed externally on the casing string 12, 20, and the seal element 44 may outwardly circumscribe the supports 54.

In addition, the above disclosure provides a method of sealing an annulus 52 formed between first and second surfaces 48, 46 in a subterranean well. The method includes the steps of: positioning a seal element 44 comprising a swellable material 42 in the annulus 52, with the swellable material 42 being positioned between the first surface 48 and the second surface 46; and flowing cement 16 or 22 through at least one channel 38 formed between the swellable material 42 and the first surface 48.

The method may also include the step of permitting the swellable material 42 to swell, whereby the seal element 44 contacts and seals against the surface 46. The swellable material 42 may swell and the seal element 44 may seal against the surface 46 after the cement flowing step.

The surface 46 may comprise at least one of a surface 34 of another casing string 12, and a surface 28 of an earth formation 30.

The cement flowing step may include flowing the cement 16, 22 between opposite sides 40 of the seal element 44 via the channel 38.

The swellable material 42 may be spaced apart from the first surface 48 by multiple supports 54, with the channel 38 being formed between the supports 54. The supports 54 may be constructed of the swellable material 42.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of sealing in a subterranean well, the method comprising the steps of:

placing an annular seal element around an exterior of a tubular member, thereby forming at least one longitudinal channel between the seal element and the tubular member, the seal element comprising a swellable material;

positioning the tubular member and the annular seal element in the well; and flowing cement into the channel.

2. The method of claim 1, further comprising the step of permitting the swellable material to swell, whereby the seal element contacts and seals against a surface in the well.

3. The method of claim 2, wherein the swellable material swells and the seal element seals against the surface after the cement flowing step.

4. The method of claim 2, wherein the surface comprises at least one of a surface of a casing string, and a surface of an earth formation.

5. The method of claim 1, wherein the cement flowing step further comprises flowing the cement between opposite sides of the seal element via the channel.

6. A method of sealing in a subterranean well, the method comprising the steps of:

positioning an annular seal element comprising a swellable material in the well; and flowing cement into at least one channel formed longitudinally through the seal element, wherein the cement flowing step further comprises displacing a fluid out of a space formed between a plug and a packer as the cement fills the space.

7. The method of claim 6, wherein multiple channels are formed longitudinally through the seal element, and wherein the cement flowing step further comprises successively plugging the channels with the cement as a level of the cement rises in the space.

8. A well system, comprising:

a first casing string positioned in a wellbore;

a seal element comprising a swellable material which swells and thereby causes the seal element to seal against a surface in the wellbore, the seal element being positioned external to the first casing string; and at least one channel formed between the swellable material and the first casing string, with cement flowed into the channel.

9. The well system of claim 8, wherein the surface is formed on a second casing string.

10. The well system of claim 9, wherein the second casing string is external to the first casing string.

11. The well system of claim 8, wherein the surface is formed on an earth formation intersected by the wellbore.

12. The well system of claim 8, wherein the cement is continuous from a longitudinal side of the seal element through the channel and to an opposite longitudinal side of the seal element.

13. The well system of claim 8, wherein the swellable material is spaced apart from the first casing string by multiple supports, the channel being formed between the supports.

14. The well system of claim 13, wherein the supports are constructed of the swellable material.

15. The well system of claim 13, wherein the supports are formed externally on the first casing string, and wherein the seal element outwardly circumscribes the supports.

16. The well system of claim 13, wherein the supports bias the seal element outward toward the surface.

17. The well system of claim 13, wherein the supports bias the seal element outward toward the surface in response to exposure of the supports to a predetermined temperature.

18. The well system of claim 13, wherein the supports bias the seal element outward toward the surface in response to exposure of the supports to a predetermined fluid.

19. A method of sealing an annulus formed between first and second surfaces in a subterranean well, the method comprising the steps of:

positioning a seal element comprising a swellable material in the annulus, the swellable material being positioned external to the first surface and internal to the second surface; and flowing cement through at least one channel formed between the swellable material and the first surface.

20. The method of claim 19, further comprising the step of permitting the swellable material to swell, whereby the seal element contacts and seals against the second surface.

21. The method of claim 20, wherein the swellable material swells and the seal element seals against the second surface after the cement flowing step.

22. The method of claim 19, wherein the second surface comprises at least one of a casing string surface, and an earth formation surface.

23. The method of claim 19, wherein the cement flowing step further comprises flowing the cement between opposite sides of the swellable material via the channel.

24. The method of claim 19, wherein the swellable material is spaced apart from the first surface by multiple supports, the channel being formed between the supports.

25. The method of claim 24, wherein the supports are constructed of the swellable material.

26. The method of claim 24, wherein the supports bias the seal element outward toward the second surface.

27. The method of claim 24, wherein the supports bias the seal element outward toward the second surface in response to exposure of the supports to a predetermined temperature.

28. The method of claim 24, wherein the supports bias the seal element outward toward the second surface in response to exposure of the supports to a predetermined fluid.

* * * * *